US012797709B2

(12) United States Patent
Paolello

(10) Patent No.: US 12,797,709 B2
(45) Date of Patent: Nov. 17, 2026

(54) HOCKEY PUCK LAUNCHING APPARATUS

(71) Applicant: John Paolello, Plainfield, IL (US)

(72) Inventor: John Paolello, Plainfield, IL (US)

( * ) Notice: Subject to any disclaimer, the term of this patent is extended or adjusted under 35 U.S.C. 154(b) by 116 days.

(21) Appl. No.: 18/951,250

(22) Filed: Nov. 18, 2024

(65) Prior Publication Data

US 2026/0137995 A1 May 21, 2026

(51) Int. Cl.
*A63B 69/40* (2006.01)
*A63B 69/00* (2006.01)

(52) U.S. Cl.
CPC ..... *A63B 69/406* (2013.01); *A63B 69/0026* (2013.01); *A63B 69/40* (2013.01); *A63B 2225/50* (2013.01)

(58) Field of Classification Search
CPC ... A63B 69/40; A63B 69/406; A63B 69/0024; A63B 69/0026
USPC ..... 124/6
See application file for complete search history.

(56) References Cited

U.S. PATENT DOCUMENTS 3,585,978 A * 6/1971 Hurlimann ..... A63B 69/40 124/31
3,588,110 A * 6/1971 Hirsch ..... A63F 9/0243 273/127 R
3,602,208 A * 8/1971 Huerlimann ..... A63B 69/40 124/31
3,817,235 A * 6/1974 Blake ..... A63B 69/406 124/78
3,822,688 A * 7/1974 Mayne ..... F41J 9/30 124/47
3,876,201 A * 4/1975 King ..... A63B 69/0026 124/47
4,471,746 A * 9/1984 Ando ..... A63B 69/40 124/80
5,255,917 A * 10/1993 Morrow ..... A63B 69/0026 124/6
5,647,338 A * 7/1997 Martin ..... A63B 69/0026 124/75
5,857,451 A * 1/1999 Ciluffo ..... F41B 3/04 124/6

(Continued)

FOREIGN PATENT DOCUMENTS

KR 101896651 * 9/2018
WO WO2016201066 12/2016

OTHER PUBLICATIONS

KR 101896651 Sik H Eng Tr (Year: 2018).*

*Primary Examiner* — John E Simms, Jr.

(57) ABSTRACT

A hockey puck launching apparatus for training hockey skills associated with a hockey puck traveling at speed includes a housing which defines a hopper and a chute therein. The chute is in fluid communication with the hopper and extends downwardly from the hopper with respect to the housing. The housing defines an outlet in a front end of the housing which is in fluid communication with the chute. The outlet is positioned proximate to a bottom end of the housing. A launching mechanism is mounted in the housing. The launching mechanism comprises a disc which is positioned under the chute and a drive mechanism which is operatively coupled to the disc to rotate the disc. The drive mechanism may rotate the disc such that a hockey puck lying on an upper surface of the disc is launched outwardly from the disc and out of the outlet.

13 Claims, 8 Drawing Sheets

(56) References Cited

U.S. PATENT DOCUMENTS

| | | | | |
|---|---|---|---|---|
| 6,758,203 | B1 * | 7/2004 | Wu | F41J 9/30 446/45 |
| 7,766,770 | B2 * | 8/2010 | Cucjen | A63B 69/406 124/78 |
| D806,975 | S | 1/2018 | Darmon | |
| 9,914,041 | B2 | 3/2018 | Vorozilchak | |
| 10,406,417 | B1 | 9/2019 | Le Tourneau | |
| 11,617,934 | B2 | 4/2023 | Shirley | |
| 2016/0361620 | A1 * | 12/2016 | Vorozilchak | A63B 69/0026 |

* cited by examiner

HOCKEY PUCK LAUNCHING APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to hockey puck launching apparatuses and more particularly pertains to a new hockey puck launching apparatus for training hockey skills associated with a hockey puck traveling at speed.

(2) Description of Related Art Including Information Disclosed Under 37 CFR 1.97 and 1.98

The prior art discloses myriad hockey puck launching apparatuses, including those which include deflectors to adjust an angle of release of launched hockey pucks. However, the prior art fails to describe such an apparatus in which hockey pucks are launched via placement atop a rotating disc, which includes motion sensors for detecting when hockey pucks are ejected, and comprises structure for operating the device via a smartphone.

BRIEF SUMMARY OF THE INVENTION

An embodiment of the disclosure meets the needs presented above by generally comprising a housing which defines a hopper and a chute therein. The chute is in fluid communication with the hopper and extends downwardly from the hopper with respect to the housing. The housing defines an outlet in a front end of the housing which is in fluid communication with the chute. The outlet is positioned proximate to a bottom end of the housing. A launching mechanism is mounted in the housing. The launching mechanism comprises a disc which is positioned under the chute and a drive mechanism which is operatively coupled to the disc to rotate the disc. The drive mechanism may rotate the disc such that a hockey puck lying on an upper surface of the disc is launched outwardly from the disc and out of the outlet. A processor is operatively coupled to the launching mechanism.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
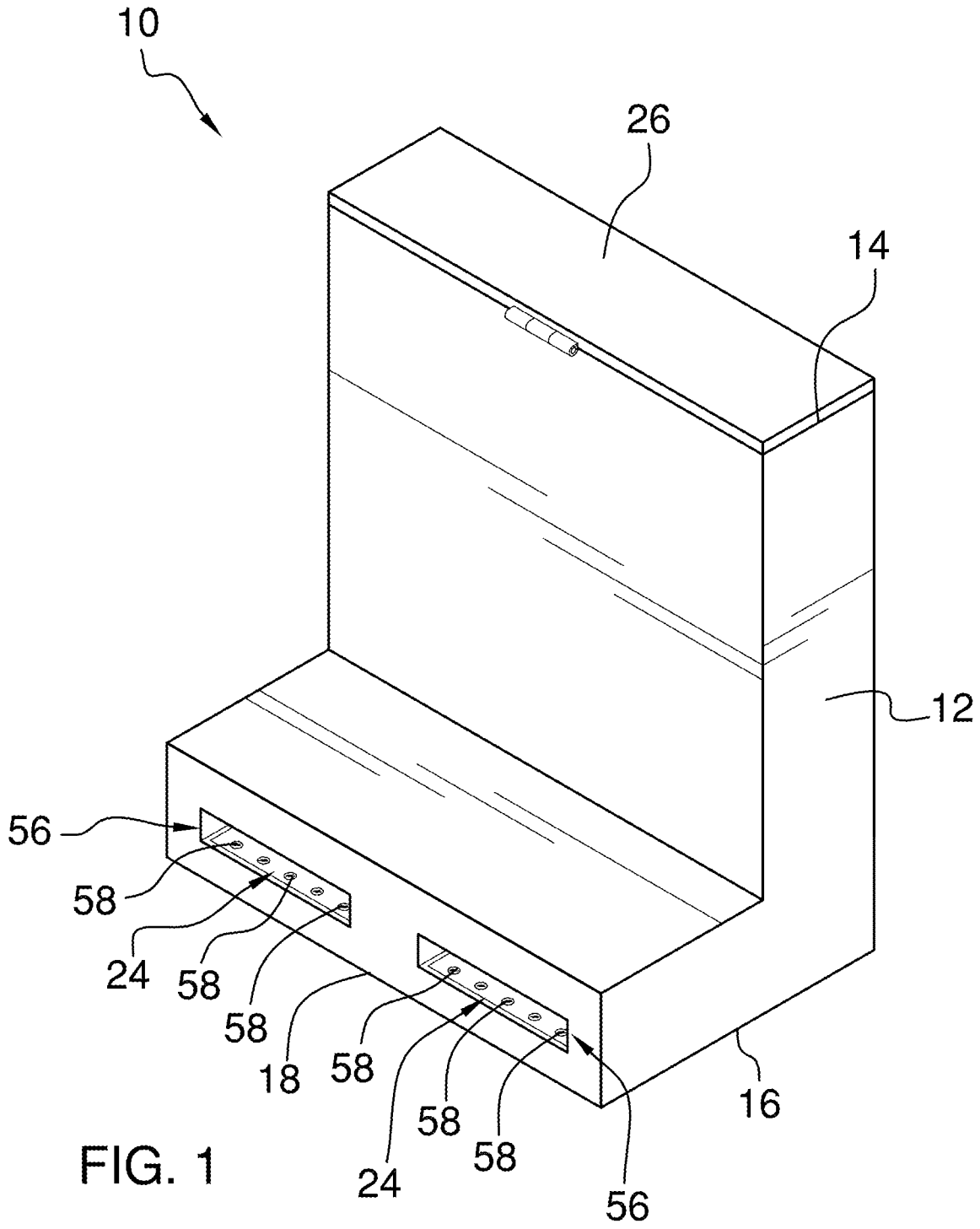
FIG. 1 is a perspective view of a hockey puck launching apparatus according to an embodiment of the disclosure.
Figure 2:
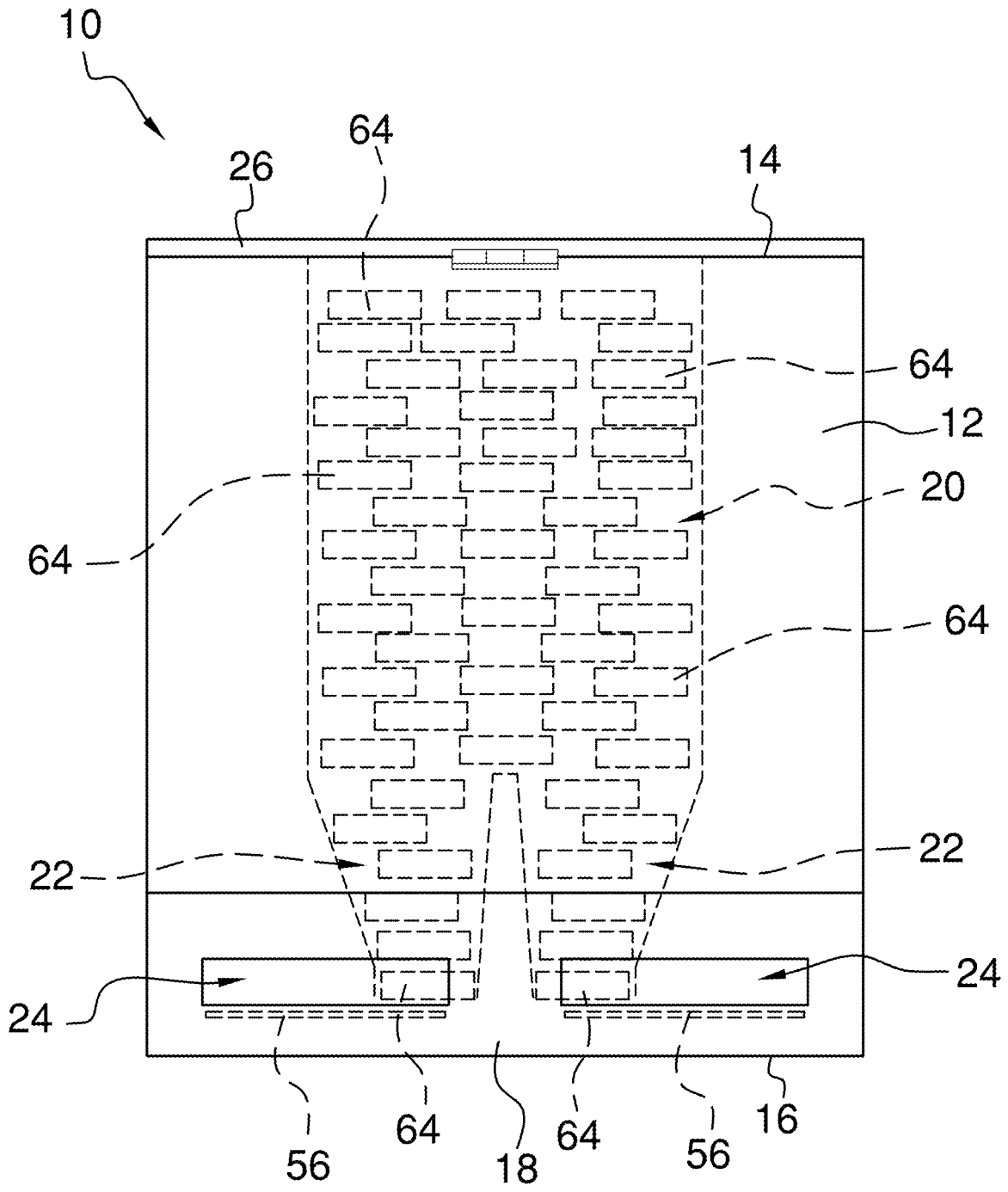
FIG. 2 is a front view of an embodiment of the disclosure.
Figure 3:
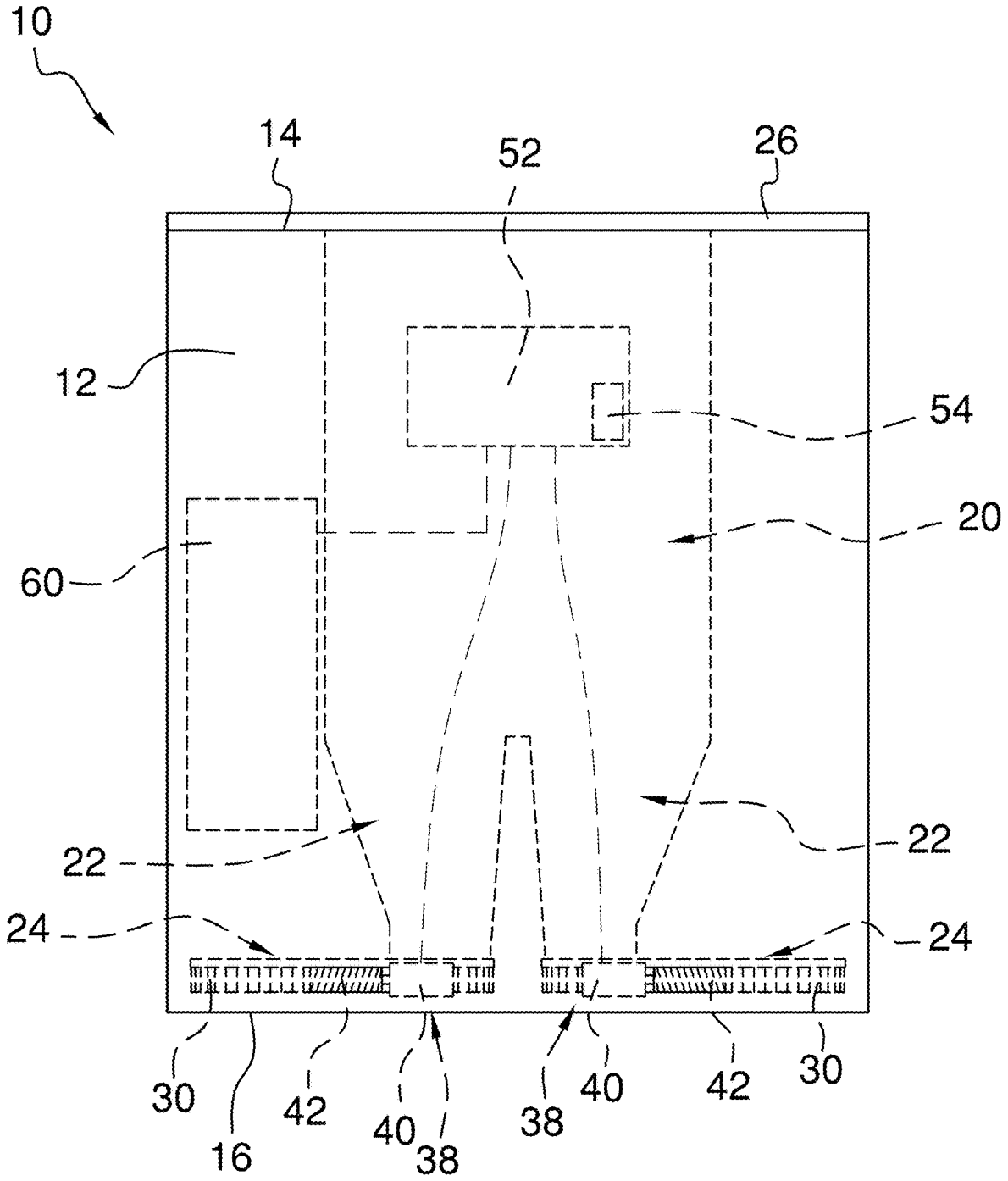
FIG. 3 is a back view of an embodiment of the disclosure.

With reference now to the drawings, and in particular to FIGS. 1 through 8 thereof, a new hockey puck launching apparatus embodying the principles and concepts of an embodiment of the disclosure and generally designated by the reference numeral 10 will be described.

As best illustrated in FIGS. 1 through 8, the hockey puck launching apparatus 10 generally comprises a housing 12 which defines a hopper 20 therein. The hopper 20 is open at a top end 14 of the housing 12 and defines a pair of chutes 22 in fluid communication with the hopper 20. Each chute 22 extends downwardly from the hopper 20 with respect to the housing 12 and tapers away from the hopper 20. The housing 12 further defines a pair of outlets 24 in a front end 18 of the housing 12, each of which is in fluid communication with an associated chute 22 of the pair of chutes 22. The pair of outlets 24 is positioned proximate to a bottom end 16 of the housing 12. A lid 26 is coupled to the housing 12 and is movable to selectively access the hopper 20. In some embodiments, wheels may be mounted to the housing 12 which may be retracted to support the housing 12 directly on a floor surface 62.

A pair of launching mechanisms 28 is mounted in the housing 12. Each launching mechanism 28 comprises a disc 30 positioned under an associated chute 22 of the pair of chutes 22 and a drive mechanism 38 for rotating the disc 30. The disc 30 of each launching mechanism 28 is rotatable about a vertical axis with respect to the housing 12 and has gear teeth 36 positioned around a perimeter 32 of the disc 30. The drive mechanism 38 of each launching mechanism 28 comprises a motor 40 and a worm gear 42, wherein the motor 40 is operatively coupled to the worm gear 42 and the worm gear 42 is operatively coupled to the disc 30 via meshing with the gear teeth 36. In other embodiments, the drive mechanism 38 may comprise a belt-and-pulley assembly, a chain-and-sprocket assembly, another geartrain, or other suitable energy transmission assembly.

A pair of guide assemblies 44 is mounted in the housing 12. Each guide assembly 44 is positioned between an associated launching mechanism 28 of the pair of launching mechanisms 28 and an associated outlet 24 of the pair of outlets 24 of the housing 12. Each guide assembly 44 of the pair of guide assemblies 44 comprises a platform 46 and a guide actuator 48. The platform 46 is positionable via the guide actuator 48 among a range of angles with respect to the housing 12. The platform 46 is positionable to align with an upper surface 34 of the disc 30 of the associated launching mechanism 28. The platform 46 is also positionable to extend from the associated launching mechanism 28 forwardly and upwardly with respect to the housing 12. The guide actuator 48 comprises a guide motor 50 which is operable to rotate the platform 46 through the range of angles. In other embodiments, the guide actuator 48 may comprise a linear actuator or other suitable actuator.

A processor 52 is mounted in the housing 12 and is operatively coupled to the pair of launching mechanisms 28 and the guide actuators 48 of the pair of guide assemblies 44. A transceiver 54 is operably coupled to the processor 52 such that the processor 52 is configured to wirelessly communicate with a remote electronic device 70 via the transceiver 54. The processor 52 is programmed to receive commands from the remote electronic device 70 to control the processor 52. The remote electronic device 70 may be a smartphone, a tablet, a computer, or the like. In other embodiments, other user control interfaces may be operatively coupled to the processor 52 and may be mounted on the housing 12.

A pair of motion sensing modules 56 is mounted in the housing 12 and is operatively coupled to the processor 52. Each motion sensing module 56 is positioned adjacent to an associated outlet 24 of the pair of outlets 24 of the housing 12 and is configured to detect motion through the associated outlet 24. Each motion sensing module 56 comprises a plurality of motion sensors 58 distributed laterally with respect to the housing 12 along the associated outlet 24.

Figure 4:
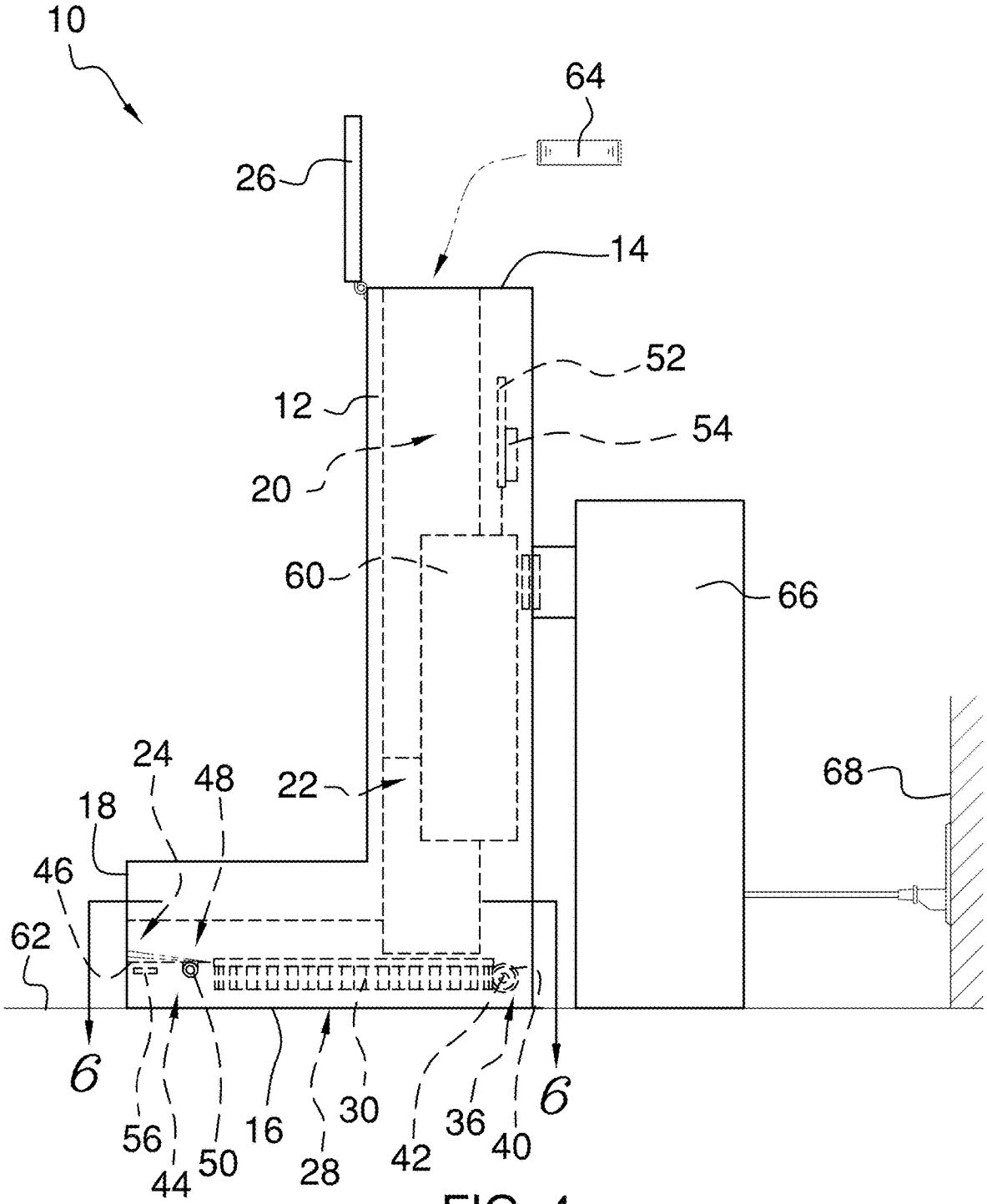
FIG. 4 is a side view of an embodiment of the disclosure.
Figure 5:
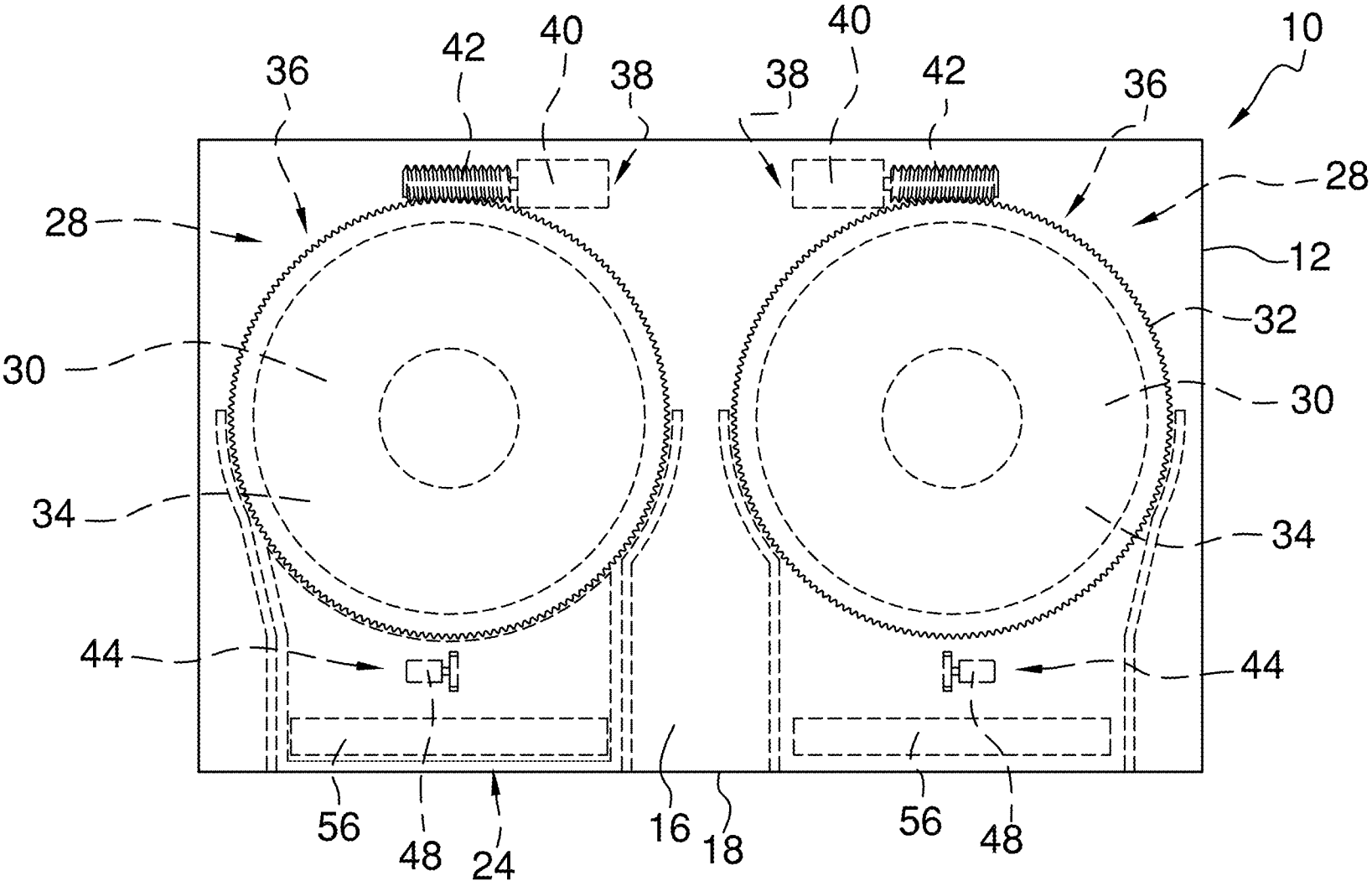
FIG. 5 is a bottom view of an embodiment of the disclosure.
Figure 6:
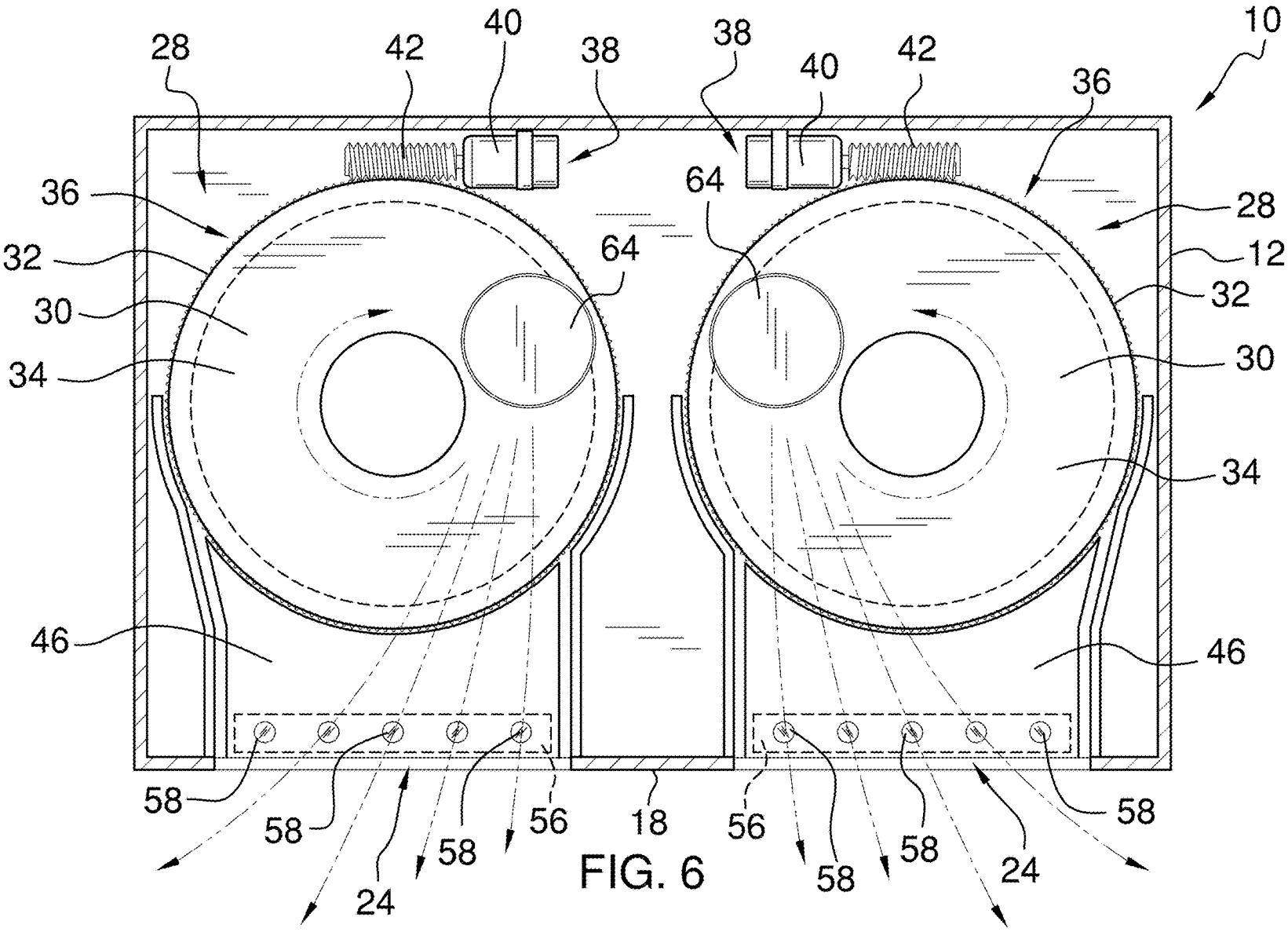
FIG. 6 is a cross-section view of an embodiment of the disclosure taken from Line 6-6 in FIG. 4.
Figure 7:
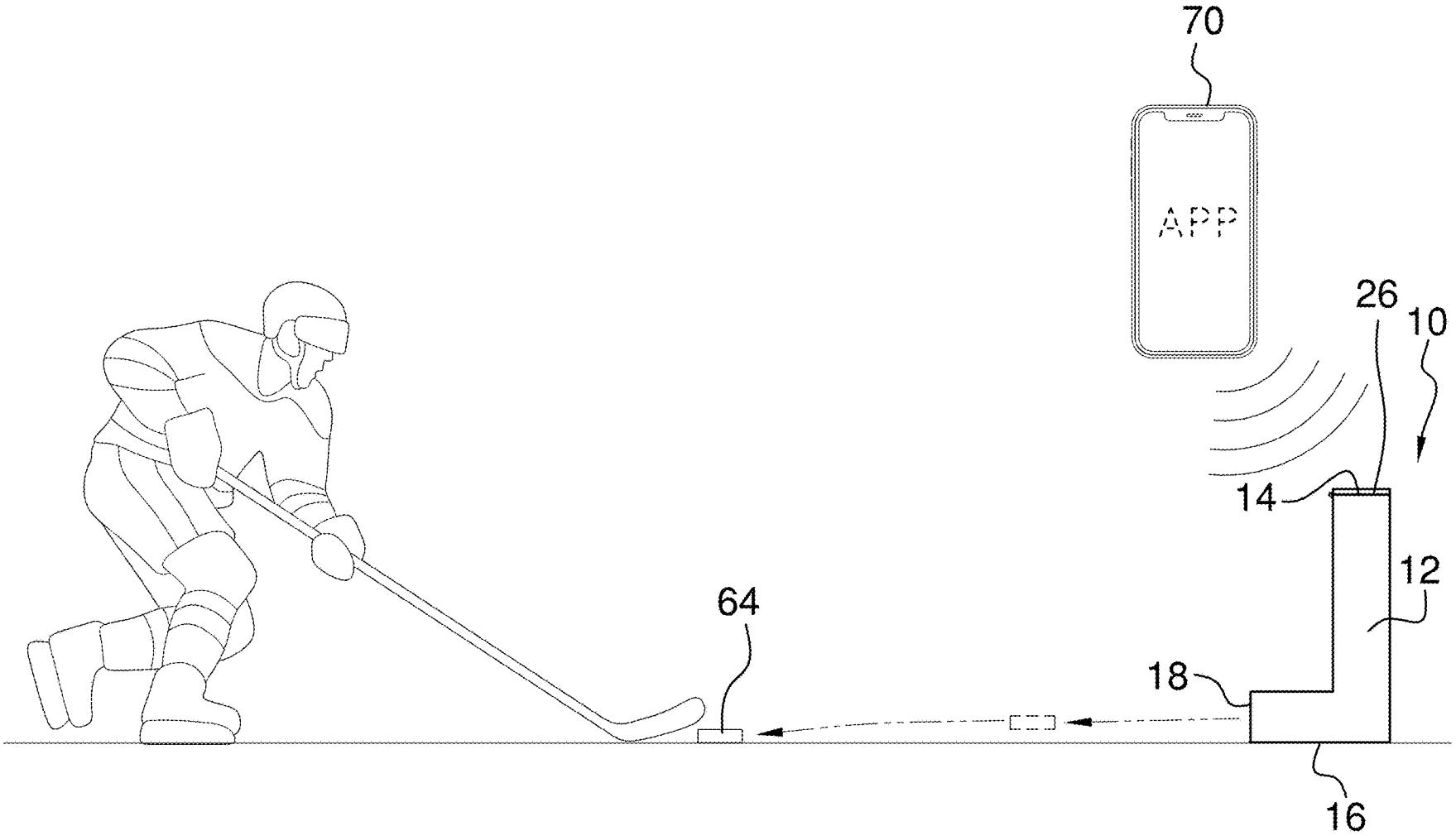
FIG. 7 is an in-use view of an embodiment of the disclosure.
Figure 8:
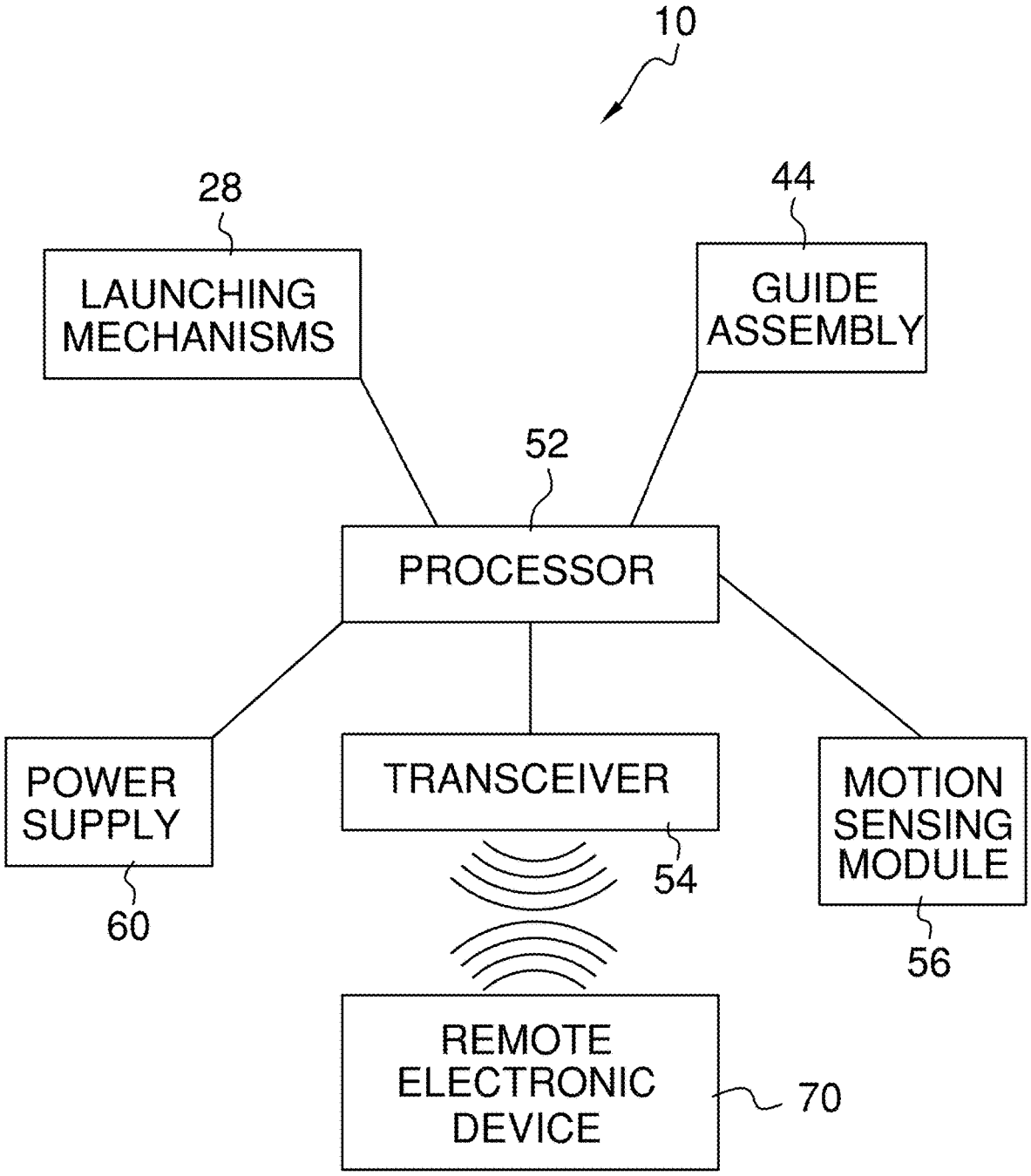
FIG. 8 is a block diagram of an embodiment of the disclosure.

A power supply 60 is mounted in the housing 12 and is electrically coupled to the processor 52. The power supply 60 comprises a battery but may comprise a capacitor or other suitable power storage. The power supply 60 may be rechargeable via an electrical port, wireless charging device, or the like. FIG. 4 depicts a wireless charging device 66 which obtains electrical power from an external power source via an electrical receptacle 68. The wireless charging device 66 may operate via inductive coupling or any other suitable wireless power transfer mechanism.

In use, hockey pucks 64 may be placed in the hopper 20 which fall via gravity through the chutes 22 toward the launching mechanisms 28. Hockey pucks 64 are deposited onto the upper surfaces 34 of the discs 30 of the launching mechanisms 28 and are launched by rotating the discs 30 at a speed sufficient to cause the hockey pucks 64 to overcome friction with the discs 30. The hockey pucks 64 are launched through the outlets 24. The motion sensing modules 56 detect when hockey pucks 64 launch out of the outlets 24 and communicates a signal indicating as much to the processor 52. In some embodiments, a release mechanism may be used to selectively release hockey pucks 64 from the chutes 22 onto the discs 30 of the launching mechanisms 28. In such embodiments, the processor 52 may cause the release mechanism to release a puck only after a previously released puck has been detected leaving through the associated outlet 24. The platforms 46 of the guide assemblies 44 may be set to direct launched hockey pucks 64 at selected angles, which may include a horizontal direction with respect to the housing 12 and directions which extend forwardly from the housing 12 and form acute angles with the horizontal direction. The hockey pucks 64 may be launched at an angle sufficient to cause the hockey pucks 64 to slide across an ice rink or other floor surface upon which the housing 12 is set.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hockey puck launching apparatus comprising:

a housing, the housing defining a hopper therein, the hopper defining a chute in fluid communication with the hopper, the chute extending downwardly from the hopper with respect to the housing, the housing defining an outlet in a front end of the housing, the outlet being in fluid communication with the chute, the outlet being positioned proximate to a bottom end of the housing;

a launching mechanism mounted in the housing, the launching mechanism comprising:

a disc positioned under the chute, the disc being rotatable with respect to the housing; and a drive mechanism operatively coupled to the disc to rotate the disc; and a processor operatively coupled to the launching mechanism;

wherein the drive mechanism comprises a motor and a geartrain;

wherein the disc of the launching mechanism has gear teeth around a perimeter of the disc; and wherein the geartrain of the drive mechanism comprises a worm gear, the motor being operatively coupled to the worm gear, the worm gear being operatively coupled to the disc via meshing with the gear teeth.

2. The hockey puck launching apparatus of claim 1, further comprising a guide assembly mounted in the housing, the guide assembly being positioned between the launching mechanism and the outlet of the housing, the guide assembly comprising a platform, the platform being positionable among a range of angles with respect to the housing.

3. The hockey puck launching apparatus of claim 2, wherein the platform of the guide assembly is positionable to align with an upper surface of the disc of the launching mechanism.

4. The hockey puck launching apparatus of claim 2, wherein the platform of the guide assembly is positionable to extend from the launching mechanism forwardly and upwardly with respect to the housing.

5. The hockey puck launching apparatus of claim 2, wherein the guide assembly further comprise a guide actuator mounted in the housing, the guide actuator being operatively coupled to the platform to adjust the position of the platform, the guide actuator being operably coupled to the processor.

6. The hockey puck launching apparatus of claim 5, wherein the guide actuator comprises a guide motor.

7. The hockey puck launching apparatus of claim 1, further comprising a transceiver operably coupled to the processor, the processor being configured to wirelessly communicate with a remote electronic device via the transceiver.

8. The hockey puck launching apparatus of claim 1, further comprising a motion sensing module mounted in the housing and operatively coupled to the processor, the motion sensing module being positioned adjacent to the outlet of the housing, the motion sensing module being configured to detect motion through the outlet.

9. The hockey puck launching apparatus of claim 8, wherein the motion sensing module comprises a plurality of motion sensors distributed laterally with respect to the housing along the associated outlet.

10. The hockey puck launching apparatus of claim 1, further comprising a power supply mounted in the housing and electrically coupled to the processor.

11. The hockey puck launching apparatus of claim 10, wherein the power supply comprises a battery.

12. The hockey puck launching apparatus of claim 1, wherein the hopper is open at a top end of the housing, further comprising a lid coupled to the housing, the lid being movable to selectively access the hopper.

13. A hockey puck launching apparatus comprising:

a housing, the housing defining a hopper therein, the hopper being open at a top end of the housing, the hopper defining a pair of chutes in fluid communication with the hopper, each chute of the pair of chutes extending downwardly from the hopper with respect to the housing, each chute of the pair of chutes tapering away from the hopper, the housing defining a pair of outlets in a front end of the housing, each outlet of the pair of outlets being in fluid communication with an associated chute of the pair of chutes, the pair of outlets being positioned proximate to a bottom end of the housing;

a pair of launching mechanisms mounted in the housing, each launching mechanism comprising:

a disc positioned under an associated chute of the pair of chutes, the disc being rotatable about a vertical axis with respect to the housing, the disc having gear teeth around a perimeter of the disc; and a drive mechanism operatively coupled to the disc to rotate the disc, the drive mechanism comprising a motor and a worm gear, the motor being operatively coupled to the worm gear, the worm gear being operatively coupled to the disc via meshing with the gear teeth;

a pair of guide assemblies mounted in the housing, each guide assembly of the pair of guide assemblies being positioned between an associated launching mechanism of the pair of launching mechanisms and an associated outlet of the pair of outlets of the housing, each guide assembly of the pair of guide assemblies comprising:

a platform, the platform being positionable among a range of angles with respect to the housing, the platform being positionable to align with an upper surface of the disc of the associated launching mechanism, the platform being positionable to extend from the associated launching mechanism forwardly and upwardly with respect to the housing; and a guide actuator mounted in the housing, the guide actuator being operatively coupled to the platform to adjust the position of the platform, the guide actuator comprising a guide motor;

a processor operatively coupled to the pair of launching mechanisms and the guide actuators of the pair of guide assemblies, the processor being mounted in the housing;

a transceiver operably coupled to the processor, the processor being configured to wirelessly communicate with a remote electronic device via the transceiver;

a pair of motion sensing modules mounted in the housing and operatively coupled to the processor, each motion sensing module of the pair of motion sensing modules being positioned adjacent to an associated outlet of the pair of outlets of the housing, each motion sensing module of the pair of motion sensing modules being configured to detect motion through the associated outlet, each motion sensing module of the pair of motion sensing modules comprising a plurality of motion sensors distributed laterally with respect to the housing along the associated outlet;

a power supply mounted in the housing and electrically coupled to the processor, the power supply comprising a battery; and a lid coupled to the housing, the lid being movable to selectively access the hopper.

* * * * *